US007573449B2

(12) United States Patent
Aoki

(10) Patent No.: US 7,573,449 B2
(45) Date of Patent: Aug. 11, 2009

(54) METHOD OF CORRECTING UNEVENNESS OF BRIGHTNESS, CORRECTION CIRCUIT FOR CORRECTING UNEVENNESS OF BRIGHTNESS, ELECTRO-OPTICAL DEVICE, AND ELECTRONIC APPARATUS

(75) Inventor: Toru Aoki, Shiojiri (JP)

(73) Assignee: Seiko Epson Corporation, Toyko (JP)

( * ) Notice: Subject to any disclaimer, the term of this patent is extended or adjusted under 35 U.S.C. 154(b) by 896 days.

(21) Appl. No.: 10/985,009

(22) Filed: Nov. 10, 2004

(65) Prior Publication Data

US 2005/0116917 A1 Jun. 2, 2005

(30) Foreign Application Priority Data

Nov. 12, 2003 (JP) ..... 2003-382482
Oct. 14, 2004 (JP) ..... 2004-299628

(51) Int. Cl.
*G09G 3/36* (2006.01)

(52) U.S. Cl. ..... 345/89; 345/99; 345/100

(58) Field of Classification Search ..... 345/87–89, 345/92, 94, 98, 99, 100, 204, 213
See application file for complete search history.

(56) References Cited

U.S. PATENT DOCUMENTS 6,462,728 B1 * 10/2002 Janssen et al. ..... 345/100
6,603,452 B1 * 8/2003 Serita ..... 345/88
2002/0080289 A1 * 6/2002 Koyama ..... 349/5
2003/0020681 A1 * 1/2003 Arita et al. ..... 345/88
2006/0214940 A1 * 9/2006 Kinoshita et al. ..... 345/589

FOREIGN PATENT DOCUMENTS

| | | |
|---|---|---|
| JP | A-05-011725 | 1/1993 |
| JP | 07-121144 | 5/1995 |
| JP | A-07-181931 | 7/1995 |
| JP | A 10-084551 | 3/1998 |
| JP | A-10-307565 | 11/1998 |
| JP | A-11-102172 | 4/1999 |
| JP | A-11-295697 | 10/1999 |
| JP | 2000-098343 | 4/2000 |
| JP | 2001-343954 | 12/2001 |

* cited by examiner

*Primary Examiner*—Amare Mengistu
*Assistant Examiner*—Hong Zhou
(74) *Attorney, Agent, or Firm*—Oliff & Berridge, PLC

(57) ABSTRACT

To correct unevenness of brightness caused from unevenness in a cell gap, etc. with high accuracy. When unevenness of brightness of pixels is corrected by adding correction data corresponding to a pixel to image data specifying the brightness of the pixel, a plurality of vertical scan periods is used as a reference cycle, and during the respective vertical scan periods of the reference cycle, one of two data values between which a correction amount of the pixel is interposed is selected and the selected data value is output as correction data. At this time, the number of times when one of the two data values is supplied during the reference cycle is increased as the correction amount comes close to the one data value.

18 Claims, 11 Drawing Sheets

CONVERSION DETAILS OF COVERSION CIRCUIT

| | 0 | 1/4 | 2/4 | 3/4 | 1 |
|---|---|---|---|---|---|
| FIRST VERTICAL SCAN PERIOD | 0 | 0 | 0 (0) | 0 | 1 |
| SECOND VERTICAL SCAN PERIOD | 0 | 0 | 1 (0) | 1 | 1 |
| THIRD VERTICAL SCAN PERIOD | 0 | 0 | 0 (1) | 1 | 1 |
| FOURTH VERTICAL SCAN PERIOD | 0 | 1 | 1 (1) | 1 | 1 |

METHOD OF CORRECTING UNEVENNESS OF BRIGHTNESS, CORRECTION CIRCUIT FOR CORRECTING UNEVENNESS OF BRIGHTNESS, ELECTRO-OPTICAL DEVICE, AND ELECTRONIC APPARATUS

BACKGROUND

The present invention relates to a technique of correcting unevenness of brightness of a display panel such as a liquid crystal panel with high accuracy.

Display panels for performing a display using electro-optical variation of an electro-optical material, such as display panels using liquid crystal, can be classified into several kinds depending upon driving types thereof. However, active matrix display panels for driving pixel electrodes with three-terminal switching elements have approximately the following structure. That is, in this kind of liquid crystal panel, liquid crystal is interposed between a pair of substrates, and one substrate is provided with a plurality of scanning lines and a plurality of data lines to intersect each other and with pairs of a three-terminal switching element and a pixel electrode to correspond to the respective intersections. The other substrate is provided with a transparent counter electrode (common electrode) to be opposite to the pixel electrodes, and the counter electrode is kept at a constant potential. In addition, the respective opposite surfaces of both substrates are provided with an alignment film having been subjected to a rubbing process such that a major-axis direction of liquid crystal molecules is continuously twisted, for example, by about 90° between both substrates, while the respective rear-surface sides of both substrates are provided with a polarizer corresponding to the alignment direction.

Here, the switching elements provided at the intersections between the scanning lines and the data lines are turned on when scanning signals applied to the scanning lines reach an active level, and thus image signals sampled into the data lines are supplied to the pixel electrodes. For this reason, a voltage as a difference between the potential of the counter electrode and the potential of the image signals is applied to the liquid crystal layer interposed between both electrodes of the pixel electrode and the counter electrode. Thereafter, even when the switching elements are turned off, the applied voltage is kept by the liquid crystal layer itself or storage capacitors provided additionally.

At this time, light transmitted between the pixel electrodes and the counter electrode is optically rotated by about 90° depending upon degrees of twist of liquid crystal molecules when an effective voltage value between both electrodes is zero, while the liquid crystal molecules are inclined in an electric-field direction as the effective voltage value is increased, so that the optical rotation disappears. For this reason, for example, in a transmissive liquid crystal panel, polarizers of which polarizing axes are perpendicular to each other are disposed correspondingly to an alignment direction at the incident side and the rear-surface side, respectively (normally-white mode). In this case, when the effective voltage value between both electrodes is zero, the light is transmitted and thus a white color is displayed (the transmittance is increased), while the quantity of light to be transmitted is decreased as the effective voltage value is increased and thus a black color is displayed (the transmittance is minimized). Therefore, by controlling the voltages applied to the pixel electrodes in a unit of pixel, a predetermined display is possible.

However, in the liquid crystal panel, when the thickness of a liquid crystal layer (that is, a cell gap) is not uniform, for example, as shown in FIG. 11A, brightness difference occurs even if the same brightness is intended to be displayed all over the pixels, and the brightness difference is visible as unevenness of brightness. In the light and darkness, here, it is dark when the liquid crystal layer is thin and it is bright when the liquid crystal layer is thick, but when the mode is changed, this relation may be reversed.

In order to make the unevenness of brightness invisible, there has been suggested a technique of making the brightness of pixels uniform by adding correction signals for increasing brightness to image signals supplied to the dark pixels.

There has also been suggested a technique of digitally processing the above correction. In this technique, data indicating a brightness correction amount are stored in advance for each pixel (every area divided plurally) of the liquid crystal panel. When an image signal is supplied to an arbitrary pixel, data corresponding to the pixel are read out, the correction amount thereof is added to the image signal, and then the added signal is supplied to the pixel. Specifically, when the unevenness of brightness shown in FIG. 11A occurs, for example, the correction amounts shown in FIG. 11B are added to the image signals of the pixels belonging to the respective areas. In FIG. 11B, the correction amounts are values obtained by expressing voltage data to be added to the image signals in decimal values.

SUMMARY

Recently, the technique of controlling the cell gap has been improved, so that the unevenness of brightness shown in FIG. 11A has been removed. However, when the cell gap is minutely varied, there has occurred a problem that the unevenness of brightness due to variation of the cell gap cannot be sufficiently minutely corrected with discrete amounts of correction. For example, as shown in FIG. 12A, in a case where the cell gap is gradually decreased from the left end of a display area 100*a* to the right end thereof, the right end is slightly darker than the left end. Therefore, in order to remove the brightness difference, when the brightness correction amount of the pixels positioned in the left half is set to be zero and the brightness correction amount of the pixels positioned in the right half is set to be "1", a brightness difference $\Delta T$ due to a voltage difference corresponding to the least significant bit of the data indicating the correction amount, that is, a voltage difference corresponding to a resolution of a D/A converter, is generated at the boundary as shown in FIG. 12B, so that the brightness difference is clearly visible. Of course, by increasing the number of bits on quantizing the correction amount and thus further enhancing the resolution of the D/A converter, the brightness difference at the boundary A may be invisible. However, in this case, since the structures of the D/A converter and the peripheries thereof become complex due to the increase in the number of bits, there is a disadvantage that cost will increase.

The present invention is contrived to solve the aforementioned problems and it is an object of the present invention to provide a method of correcting unevenness of brightness, a correction unit for correcting unevenness of brightness, an electro-optical device, and an electronic apparatus, in which the unevenness of brightness caused from unevenness in a cell gap, etc. can be corrected with high accuracy to make brightness difference invisible.

[Means for Solving the Problems]

In order to accomplish the above object, according to the present invention, there is provided a method of correcting unevenness of brightness of pixels by adding correction data corresponding to a pixel to image data specifying the brightness of the pixel, wherein a reference cycle includes a plurality of vertical scan periods and during the respective vertical scan periods of the reference cycle, one of two different data values is selected and the selected data value is output as correction data, and wherein the number of times when one of the two data values is supplied during the reference cycle is increased as a correction amount comes close to the one data value. According to this method, it is possible to correct the unevenness of brightness with a resolution finer than the number of bits of the correction data.

In the present invention, a time when the two data values are alternately supplied may be provided in every vertical scan period, or the same data value may be supplied during two vertical scan periods and a time when the two data values are alternately supplied may be provided in every two vertical scan periods.

In the present invention, data indicating the correction amount may be stored in advance correspondingly to the respective pixels. According to this method, since the correction amounts correspond to the respective pixels, it is possible to correct the unevenness of brightness with high accuracy. However, since a large storage capacity is required for storing the data indicating the correction amounts, a plurality of reference coordinates may be determined in advance in a pixel area and data indicating the correction amount may be stored for each reference coordinate. Here, data indicating a correction amount of a pixel may be obtained by interpolating the correction amount of the respective reference coordinates in accordance with distances between the reference coordinates and the pixel. According to this method, the storage capacity may be a capacity enough to store the data indicating the brightness correction amounts at the reference coordinates.

According to the present invention, there is also provided an electro-optical device in which a plurality of pixels is disposed in a display area and image signals obtained by converting image data into analog signals are supplied to the pixels, the electro-optical device comprising: a memory for storing in advance predetermined brightness correction amounts for the plurality of pixels; and a correction circuit for employing a plurality of vertical scan periods as a reference cycle, correcting the image data using predetermined correction data every predetermined number of vertical scan periods of the reference cycle, and increasing the number of vertical scan periods during which the image data are corrected as the pixels have a larger brightness correction amount.

The present invention can be embodied as the method of correcting unevenness of brightness in an electro-optical device, the correction circuit for correcting unevenness of brightness in an electro-optical device, and the electro-optical device itself. An electronic apparatus according to the present invention may have the display panel of the electro-optical device as a display unit.

DETAILED DESCRIPTION OF EMBODIMENTS

Figure 1:
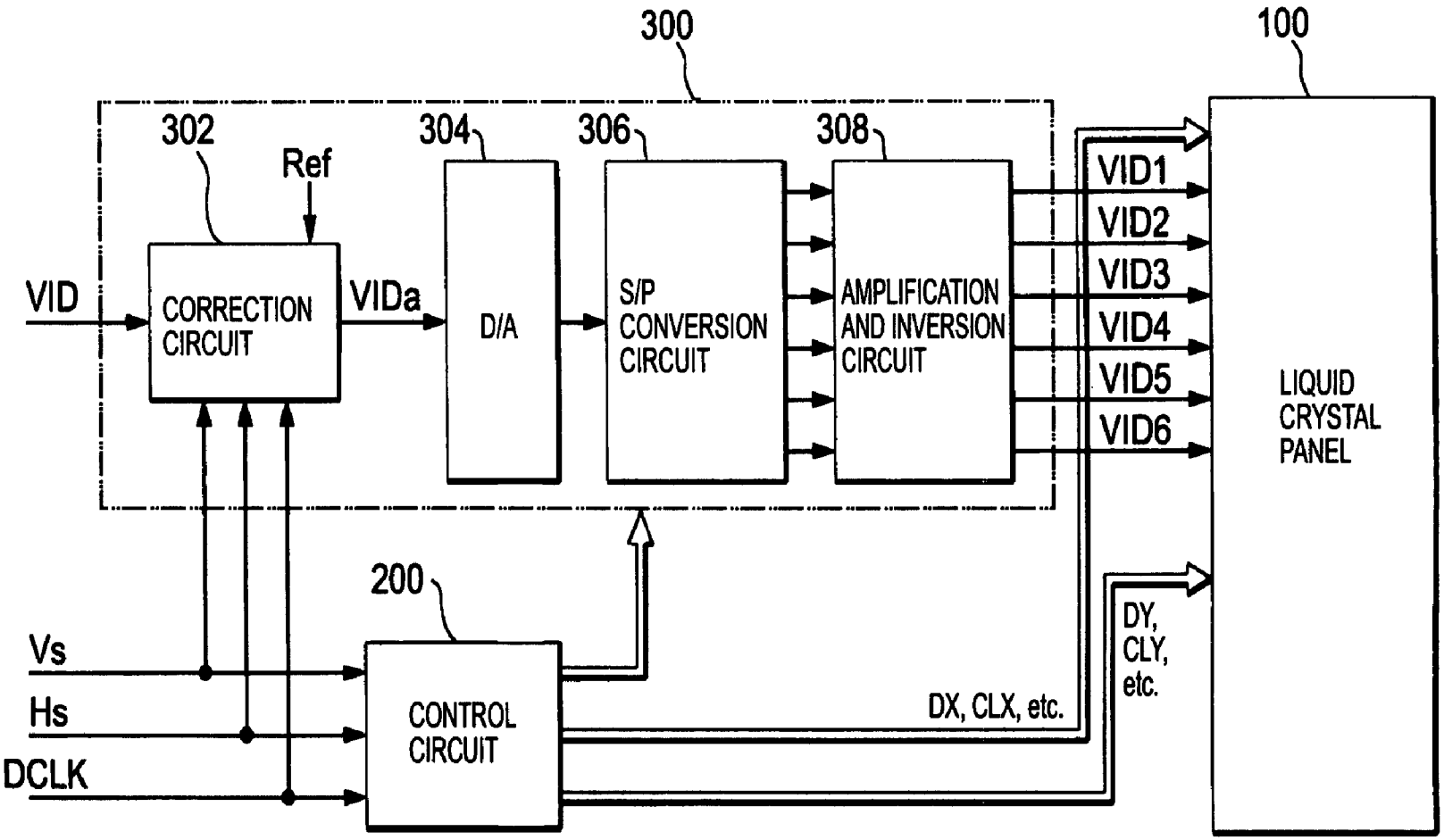
FIG. 1 is a block diagram illustrating the whole structure of an electro-optical device according to an embodiment of the present invention.

Now, embodiments of the present invention will be described with reference to the figures. FIG. 1 is a block diagram illustrating the whole structure of an electro-optical device having a correction circuit according to the present embodiment.

As shown in the figure, the electro-optical device comprises a liquid crystal panel 100, a control circuit 200, and an image-signal processing circuit 300. The control circuit 200 generates timing signals or clock signals for controlling respective parts in response to a vertical scan signal Vs, a horizontal scan signal Hs, and a dot clock signal DCLK supplied from upper-level units not shown. The control circuit 200 and the image-signal processing circuit 300 may be formed on a substrate constituting the liquid crystal panel.

The image-signal processing circuit 300 comprises a correction circuit 302, a D/A converter 304, an S/P conversion circuit 306, and an amplification and inversion circuit 308. The correction circuit 302 corrects data image data VID supplied from an upper-level unit not shown in synchronism with the vertical scan signal Vs, the horizontal scan signal Hs, and the dot clock signal DCLK (that is, in accordance with the vertical scan and the horizontal scan) as described later and then outputs image data VIDa. Details of the correction circuit 302 will be described later.

The D/A converter 304 converts the corrected image data VIDa into analog image signals. The S/P conversion circuit 306 receives the analog image signals, distributes the analog image signals into N (N=6 in the figure) systems, expands (serial-to-parallel converts) the analog image signals to N times on the temporal axis, and then outputs the expanded analog image signals. The reason for serial-parallel converting the image signals is to elongate the time when the image signals are applied and to secure a sampling and holding time and a charging and discharging time at sampling switches 151 (see FIG. 5) to be described later. The amplification and inversion circuit 308 inverts signals requiring inversion of polarity among the serial-parallel converted image signals, then properly amplifies the inverted signals, and supplies the amplified image signals as image signals VID1 to VID6 to the liquid crystal panel 100. Here, the inversion of polarity may be performed (1) in a unit of scanning lines, (2) in a unit of data signal lines, and (3) in a unit of pixels, but for the purpose of convenient explanation in the present embodiment, the mode of performing the inversion of polarity (1) in a unit of scanning lines is exemplified. However, it is not intended to limit the present invention to this mode.

In the present embodiment, the inversion of polarity means that the voltage level is alternately inverted centering about a predetermined amplitude-center potential (approximately equal to the voltage LCcom applied to the counter electrode) of the image signals. In the present embodiment, the writing of applying a voltage higher than the amplitude-center potential to the pixel electrodes is referred to as a positive writing and the writing of applying a voltage lower than the amplitude-center potential to the pixel electrodes is referred to as a negative writing.

At this time, instead of amplifying the image signals, the potential of the counter electrode may be amplified such that the potential LCcom of the counter electrode is higher or lower than the image signals.

In the present embodiment, the image data VIDa corrected by the correction circuit 302 are converted into analog signals, but the analog conversion may be performed after the serial-parallel conversion or after the amplification and inversion, of course. In addition, the image signals VID1 to VID6 are simultaneously supplied to the liquid crystal panel 100 in the present embodiment, but may be sequentially shifted in synchronism with the dot clock. In this case, the image signals of the N systems may be sequentially sampled by a sampling circuit to be described later.

Figures 2, 3:
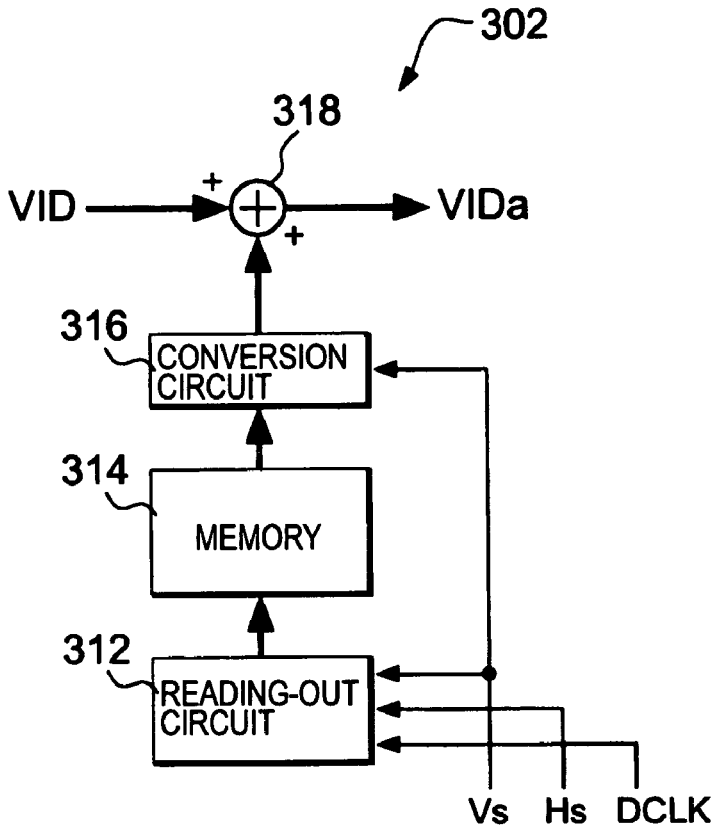
FIG. 2 is a block diagram illustrating a structure of a correction circuit in the electro-optical device.
FIG. 3 is a table illustrating states where correction data are supplied during respective vertical scan periods.

FIG. 2 is a block diagram illustrating a detailed structure of the correction circuit 302.

Figure 4A:
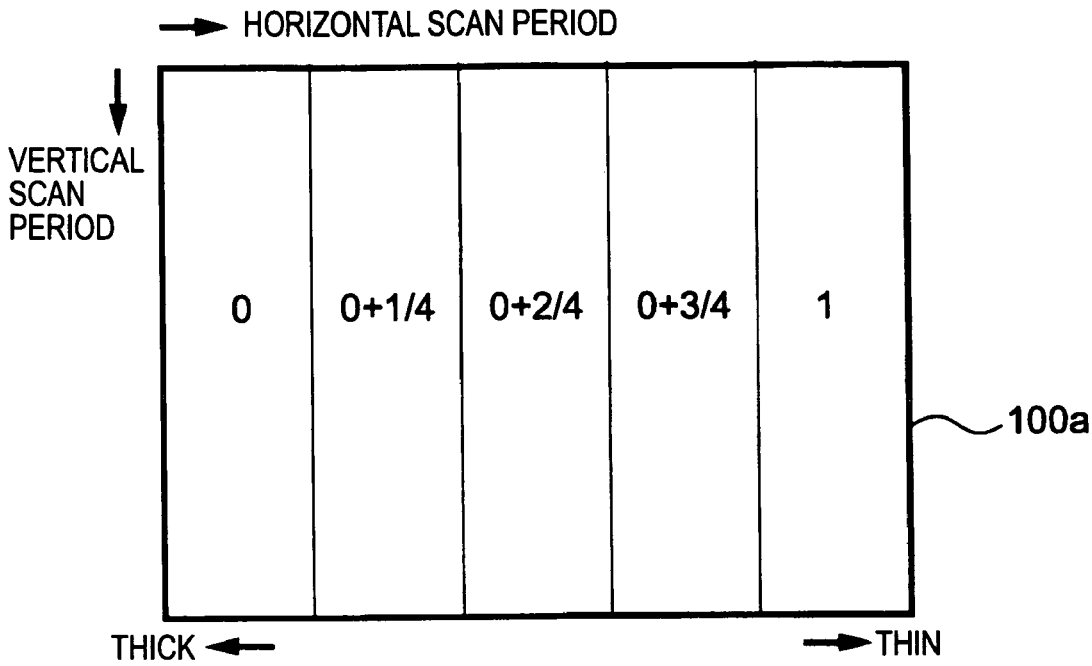
FIG. 4 is a diagram illustrating a relation between correction data of the correction circuit and a pixel area.
Figure 12A:
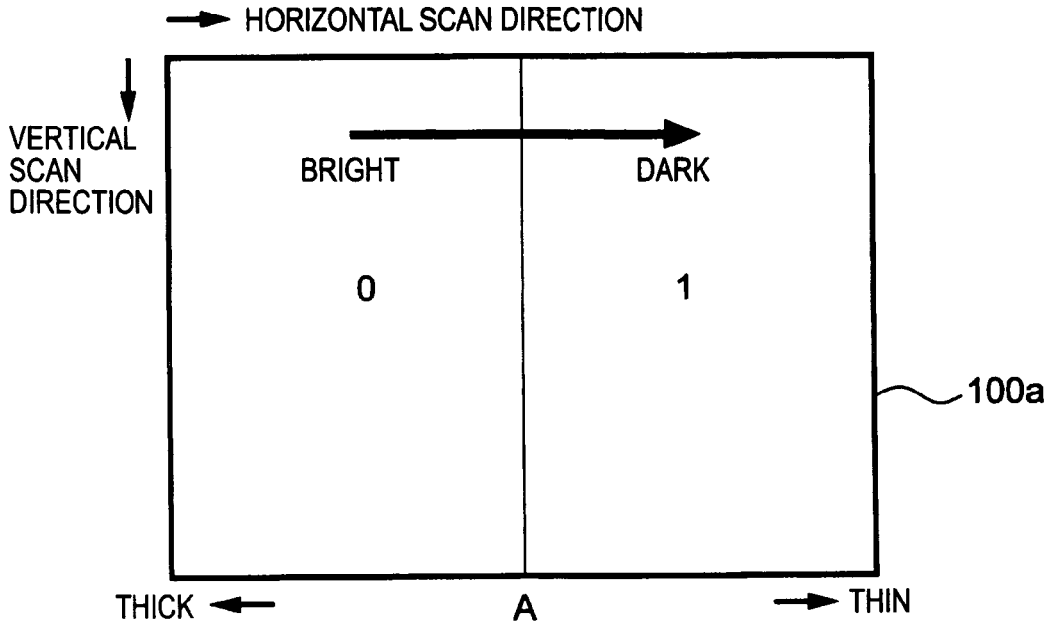
FIG. 12 is a diagram illustrating unevenness of brightness in a display panel.

In the figure, a memory 314 stores data indicating the brightness correction amount correspondingly to the respective pixels of the liquid crystal panel 100. Here, as shown in FIG. 12A, when the liquid crystal panel 100 gradually becomes thinner from the left end of the display area 100*a* to the right end thereof, the data indicating the brightness correction amount are stored in the memory 314 as shown in FIG. 4A. Specifically, the display area 100*a* is divided into five sub-areas depending upon values of the cell gap, and the correction amounts of "0", "¼" (=0.25), "⅔" (=0.5), "¾" (=0.75), and "1" are sequentially stored correspondingly to the respective pixels from the left end accompanying decimal portions.

Here, for the purpose of convenience, numerals having a decimal portion are expressed in fractional numbers.

For example, when a display in which all the pixels have the same brightness is performed in the display area 100*a*, the correction amounts are obtained by measuring in advance the actual brightness of each pixel, calculating the difference from the brightness to be displayed (target brightness), and converting the amount of brightness for removing the difference into data.

A reading-out circuit 312 specifies the row and column of the pixel corresponding to the image signal currently supplied from the vertical scan signal Vs, the horizontal scan signal Hs, and the dot clock DCLK, and reads out data indicating the brightness correction amount of the specified pixel from the memory 314.

A conversion circuit 316 determines to which vertical scan period of first to fourth vertical scan periods the current time point belongs by counting the vertical scan signal Vs, converts the read-out data on the basis of the determination result, and then outputs the converted data as correction data. In the present embodiment, using four frames of the first to fourth vertical scan periods as a reference cycle, the data read out from the memory 314 are converted in accordance with the respective vertical scan periods as shown in FIG. 3 and are output as the correction data. For example, when the read-out data for a pixel is "⅔", the read-out data are converted into "0" during the first vertical scan period, and are converted into "1", "0", and "1" during the second to fourth vertical scan periods, respectively. That is, in the present embodiment, the correction data are different depending upon the vertical scan periods but the number of bits thereof does not change.

An adder 318 adds the correction data converted by the conversion circuit 316 to the image data VID, and then outputs the added data as image data VIDa.

Figure 5:
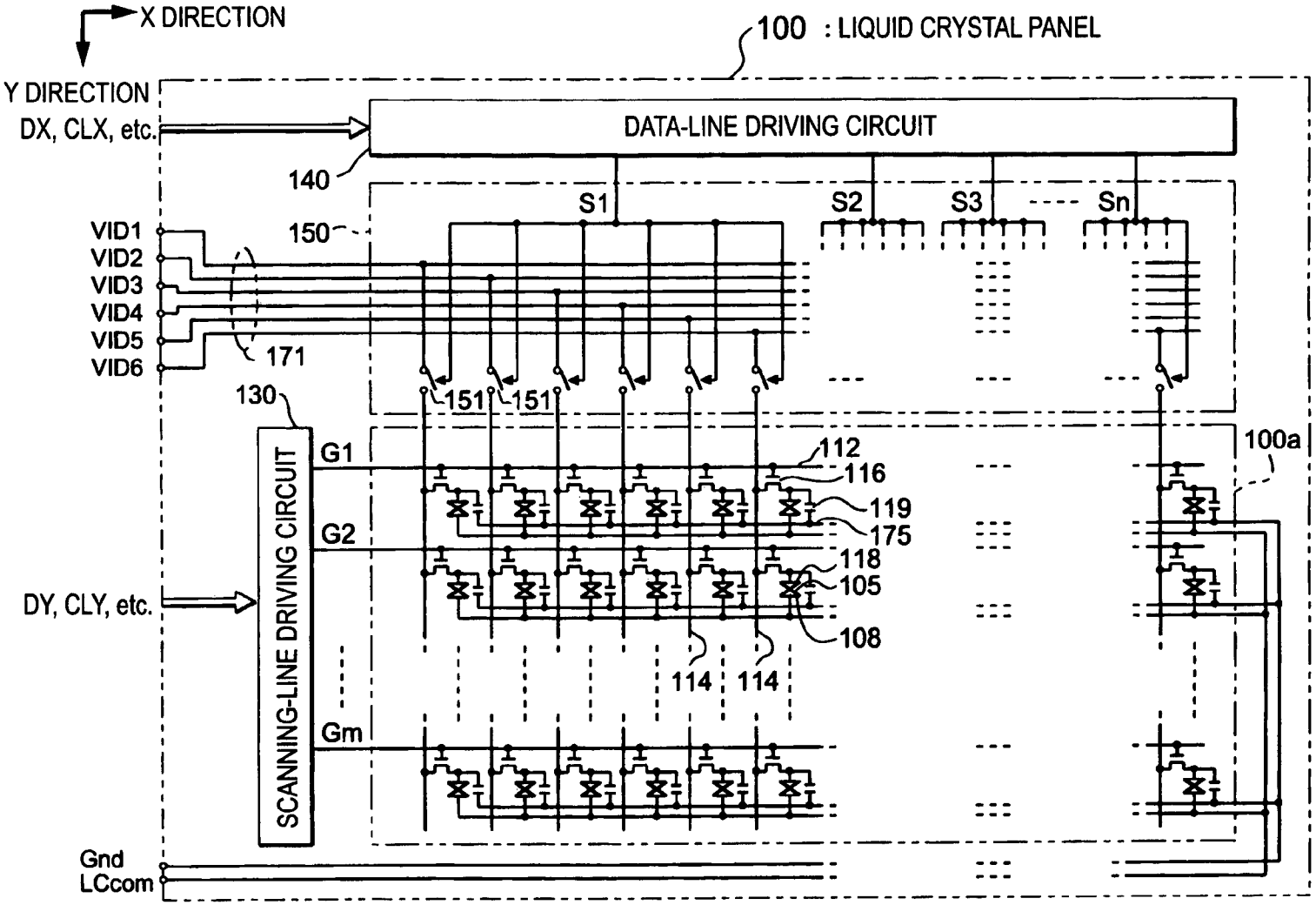
FIG. 5 is a block diagram illustrating a structure of a liquid crystal panel in the electro-optical device.

Next, a structure of the liquid crystal panel 100 will be described. FIG. 5 is a block diagram illustrating an electrical structure of the liquid crystal panel 100.

As shown in the figure, in the display area 100*a*, a plurality of scanning lines 112 is formed in parallel along the row (X) direction and a plurality of data lines 114 is formed in parallel along the column (Y) direction. At the respective intersections between the scanning lines 112 and the data lines 114, the gate of a thin film transistor (hereinafter, referred to as "TFT") 116 which is a switching element for controlling a pixel is connected to the scanning line 112, the source of the TFT 116 is connected to the data line 114, and the drain of the TFT 116 is connected to a pixel electrode 118. The counter electrode 108 kept at a constant voltage LCcom is opposed to the respective pixel electrodes 118, and the liquid crystal layer 105 is interposed between both electrodes. In the present embodiment, the normally-white mode in which the quantity of light passing between the pixel electrodes and the counter electrode is decreased as an effective voltage value between both electrodes is increased is supposed.

For the purpose of convenient explanation, supposed that the total number of scanning lines 112 is "m" and the total number of data lines 114 is "6n" (where m and n are integers), the pixels are arranged in a matrix shape of m rows (6n columns at the respective intersections between the scanning lines 112 and the data lines 114.

In addition, in the display area 100*a* including the pixels of a matrix shape, a storage capacitor 119 is formed at each pixel so as to prevent leakage of electric charges in the liquid crystal layer 105. One end of the storage capacitor 119 is connected to the pixel electrode 118 (the drain of the TFT 116) and the other end is connected to a capacitor line 175 in common. In the present embodiment, the capacitor line 175 is connected to a potential Gnd, but may be a constant potential (such as the voltage LCcom, the high-potential source voltage of the driving circuit, the low-potential source voltage, etc.).

Figure 6:
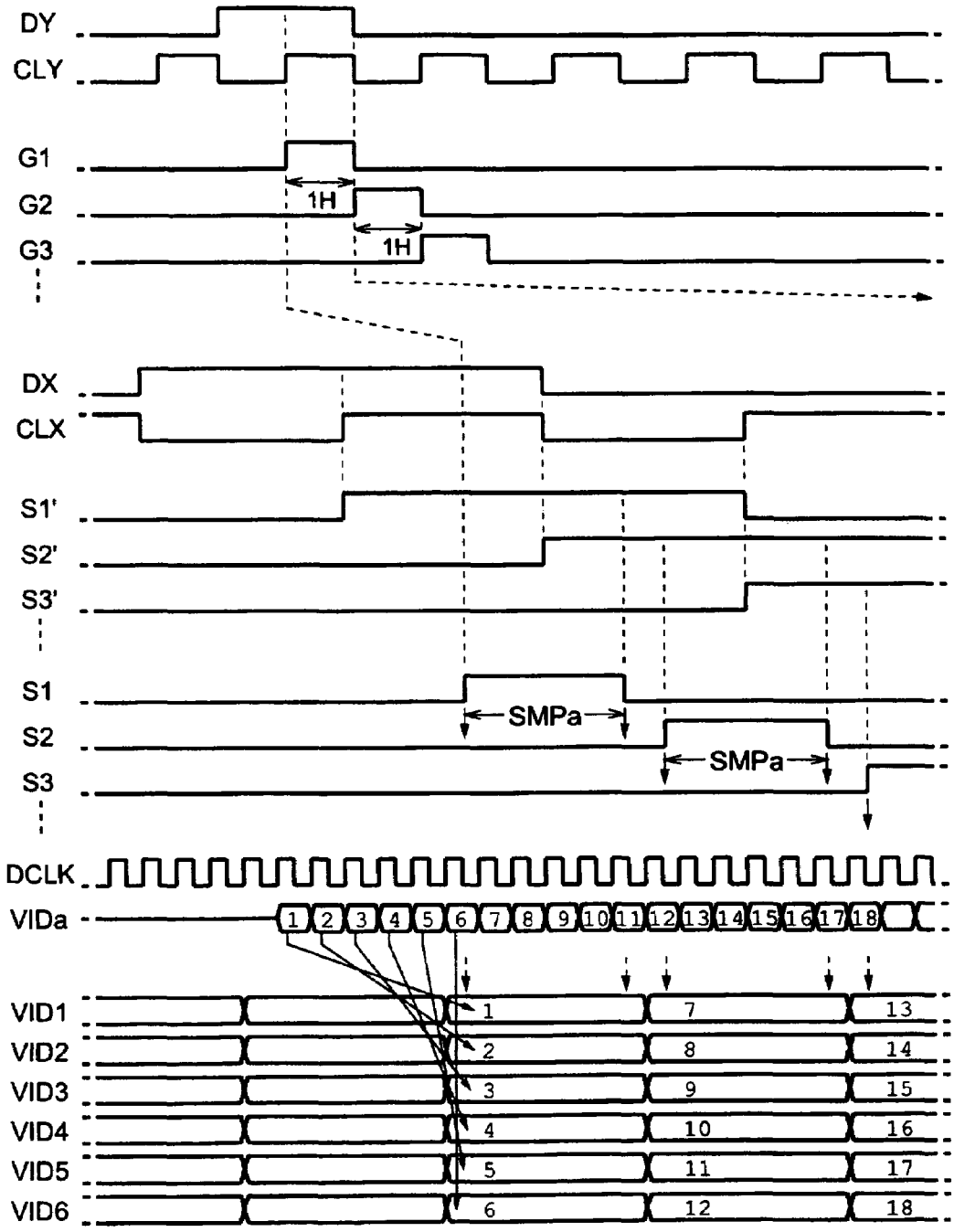
FIG. 6 is a timing chart illustrating operation of the electro-optical device.

The scanning-line driving circuit 130, the data-line driving circuit 140, and the sampling circuit 150 are provided outside the display area 100*a*. These driving elements are formed using the same manufacture process as the TFT 116 for driving the pixels, thereby contributing to decrease in size or reduction in cost of the whole apparatus. As shown in FIG. 6, the scanning-line driving circuit 130 sequentially outputs the scan signals G1, G2, . . . , Gm, which would exclusively reach an active level (H level), during each horizontal scan period (1H). Details of the scanning-line driving circuit 130 are not shown since they are not related directly to the present invention. However, the scanning-line driving circuit sequentially shifts a transmission start pulse DY which is first supplied during one vertical scan period whenever the level of the clock signal CLY is changed, and then shapes the waveform thereof, thereby generating the scanning signals G1, G2, . . . , Gm.

The data-line driving circuit 140 outputs sampling signals S1, S2, . . . , Sn which would sequentially reach an active level during one horizontal scan period. Details of the data-line driving circuit are not shown since they are not related directly to the present invention. However, the data-line driving circuit comprises a shift register and a plurality of logical product circuits. As shown in FIG. 6, the shift register sequentially shifts a transmission start pulse DX which is first supplied during one horizontal scan period whenever the level of the clock signal CLX is changed, thereby outputting signals S1', S2', S3', . . . , Sn'. The respective logical product circuits reduce the widths of the signals S1', S2', S3', . . . , Sn' into a period SMPa such that the adjacent widths are not overlapped, thereby outputting the signals S1, S2, S3, . . . , Sn.

The sampling circuit 150 samples the image signals VID1 to VID6, which are supplied through six image-signal lines 171, into the respective data lines 114 in accordance with the sampling signals S1, S2, S3, . . . , Sn, and comprises a sampling switch 151 provided at each data line 114.

Here, the data lines 114 are classified into blocks having six data lines, and the sampling switch 151 connected to one end of the data line 114 positioned at the leftmost among the six data lines 114 belonging to an i-th block (where i is 1, 2, . . . , n) from the left end of FIG. 5 samples the image signal VID1 supplied through the image-signal line 171 during the time when the sampling signal Si reaches an active level, and supplies the sampled image signal to the data line 114. The sampling switch 151 connected to one end of the data line 114 positioned at the second position from the leftmost in the block samples the image signal VID2 during the time when the sampling signal Si reaches an active level, and supplies the sampled image signal to the data line 114. Similarly, the respective sampling switches 151 connected to one end of the data lines 114 positioned at the third, fourth, fifth, and sixth positions among the six data lines 114 belonging to the block sample the image signals VID3, VID4, VID5, and VID6 during the time when the sampling signal Si reaches an active level, respectively, and supply the sampled image signals to the corresponding data lines 114.

In the present embodiment, since the TFT constituting the sampling switch 151 is an N channel type, the corresponding sampling switches 151 are turned on when the sampling signals S1, S2, . . . , Sn become an H level. The TFT constituting the sampling switch 151 may be a P channel type or a complementary type combining both channel types.

Next, operation of the electro-optical device will be described. During the first vertical scan period, the transmission start pulse DY is first supplied to the scanning-line driving circuit 130. As a result of this supply, as shown in FIG. 6, the scan signals G1, G2, G3, . . . , Gn sequentially exclusively reach an active level and are output to the respective scanning lines 112.

At this time, during one vertical scan period when the scan signal G1 reaches an active level, the image data VID corresponding to the pixels of the first column, the second column, the third column, . . . , the (6n−1)-th column in the first row are sequentially supplied to the correction circuit 302 in synchronism with the dot clock signal DCLK.

Here, when a character j which is one integer of 1 to 6n is used for generally explaining the data lines 114, the data indicating the brightness correction amount of a pixel positioned at the j-th column of the first row are read out from the memory 314 at the time when the image data VID of the pixel are supplied. During the first vertical scan period, the conversion circuit 316 converts the read-out data into the correction data of "0" when the correction amount indicated by the read-out data is "0" or "¼" or "⅔" or "¾", and converts the read-out data into the correction data of "1" when the correction amount is "1" (see FIG. 3). The converted correction data are added to the image data of the pixel positioned at the j-th column of the first row by the adder 318, are output as the image data VIDa, and then are converted into analog signals by the D/A converter 304. In addition, the image signals converted into the analog signals are developed in six phases by the S/P conversion circuit 306 and are expanded by six times on the temporal axis.

Here, supposed that the positive writing is performed during one vertical scan period when the scan signal G1 reaches an active level as the first vertical scan period, the amplification and inversion circuit 308 positively amplifies the signals converted and expanded by the S/P conversion circuit 306, to a high potential side centering about the amplitude-center potential, and outputs the amplified signals as the image signals VID1 to VID6.

On the other hand, during one horizontal scan period when the scan signal G1 reaches an active level, the transmission start pulse DX is first supplied to the data-line driving circuit 140, and the sampling signals S1, S2, S3, . . . , Sn, which are narrowed into a period SMPa such that the adjacent pulse widths are not overlapped, are sequentially output.

When the sampling signal S1 reaches an active level, the image signals VID1 to VID6 corresponding to the pixels at the first to sixth columns of the first row are sampled into six data lines 114 of the first to sixth columns. The sampled image signals VID1 to VID6 are applied to the corresponding pixel electrodes 118 through the TFTs 116 of the pixels positioned at the intersections between the first scanning line 112 from the uppermost in FIG. 5 and the six data lines 114, and are written to the first to sixth columns of the first row, respectively.

Thereafter, when the sampling signal S2 reaches an active level, the image signals VID1 to VID6 corresponding to the pixels at the seventh to twelfth columns of the first row are sampled into six data lines 114 of the seventh to twelfth columns in turn, are applied to the corresponding pixel electrodes 118 through the TFTs 116 of the pixels positioned at the intersections between the first scanning line 112 and the six data lines 114, and are written to the pixels of the seventh to twelfth columns in the first row, respectively.

Similarly, when the sampling signals S3, S4, . . . , Sn sequentially reach an active level, the image signals VID1 to VID6 are sampled into the six data lines 114 at the thirteenth to eighteenth columns, the nineteenth to twenty-fourth columns, . . . , the (6n−5)-th to 6n-th columns, respectively, and the image signals VID1 to VID6 are applied to the corresponding pixel electrodes 118 through the TFTs 116 of the pixels positioned at the intersections between the first scanning line 112 and the six data lines 114, thereby completing the writing to all the pixels of the first row.

Subsequently, a period when the scan signal G2 reaches an active level will be described. In the present embodiment, as described above, since the inversion of polarity is performed in a unit of scanning lines, the negative writing is performed during one horizontal scan period. For this reason, the image signals VID1 to VID6 are obtained by inverting and amplifying the signals converted by the S/P conversion circuit 306 to the low potential side centering about the amplitude-center potential. For the other operation, similarly to the first row, the sampling signals S1, S2, S3, . . . , Sn sequentially reach an active level and the writing to the pixels at the first to 6n-th columns of the second row is completed.

Similarly, the scan signals G3, G4, . . . , Gn reach an active level, and the writing to the pixels of the third row, the fourth row, . . . , the m-th row is performed. That is, the positive writing is performed to the pixels of the odd rows, while the negative writing is performed to the pixels of the even rows.

As a result, during the first vertical scan period, the writing to all the pixels of the first to m-th rows is completed.

Next, during the second vertical scan period, the conversion details of the conversion circuit 316 are changed as follows. That is, the conversion circuit 316 converts the read-out data into the correction data of "0" when the correction amount indicated by the data is "0" or "¼", and converts the read-out data into the correction data of "1" when the correction amount is "2/4 or "¾" or "1" (see FIG. 3).

During the second vertical scan period, the writing polarities to the pixels of the respective rows are replaced with those of the first vertical scan period. That is, during the second vertical scan period, the negative writing is performed to the pixels of the odd rows, while the positive writing is performed to the pixels of the even rows.

Next, during the third vertical scan period, the conversion details of the conversion circuit 316 are changed as follows. That is, the conversion circuit 316 converts the read-out data into the correction data of "0" when the correction amount indicated by the data is "0" or "¼" or "2/4", and converts the read-out data into the correction data of "1" when the correction amount is "¾" or "1" (see FIG. 3).

During the third vertical scan period, the writing polarities to the pixels of the respective rows are replaced with those of the second vertical scan period and are equal to those of the first vertical scan period. That is, during the third vertical scan period, the positive writing is performed to the pixels of the odd rows, while the negative writing is performed to the pixels of the even rows.

Next, during the fourth vertical scan period, the conversion details of the conversion circuit 316 are changed as follows. That is, the conversion circuit 316 converts the read-out data into the correction data of "0" when the correction amount indicated by the data is "0", and converts the read-out data into the correction data of "1" when the correction amount is "¼" or "2/4" or "¾" or "1" (see FIG. 3).

During the fourth vertical scan period, the writing polarities to the pixels of the respective rows are replaced with those of the third vertical scan period and are equal to those of the second vertical scan period. That is, during the fourth vertical scan period, the negative writing is performed to the pixels of the odd rows, while the positive writing is performed to the pixels of the even rows.

After the fourth vertical scan period, the first vertical scan period is restored and thereafter the same operation is repeated.

Here, considering a case where the image data VID of the respective pixels are equal to each other, that is, a case where the respective pixels are displayed with the same brightness, the effective voltage values applied to the liquid crystal layer of the respective pixels are reproduced up to the decimal portions of the correction amount using the first to fourth vertical scan periods as the reference cycle. On the other hand, the number of bits constituting the correction data of the conversion circuit 316 does not change.

Figure 4B:
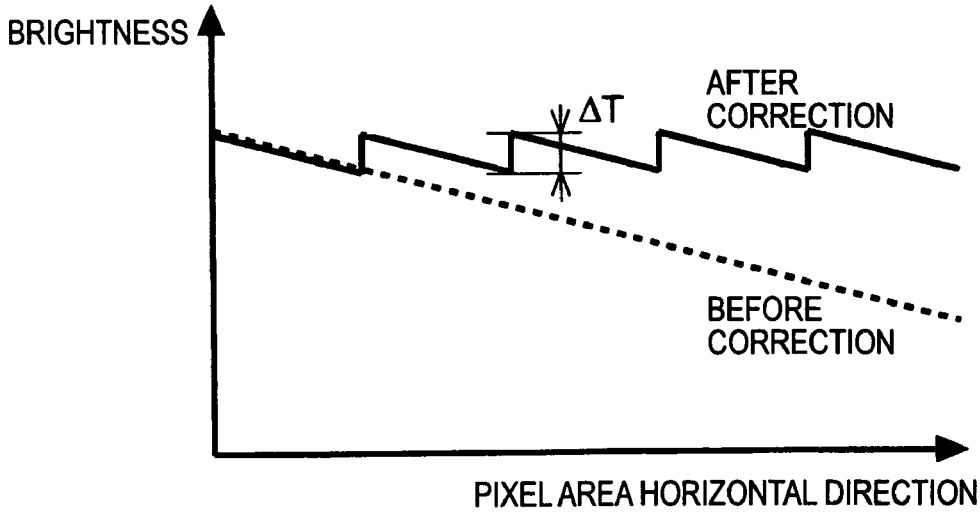
Figure 12B:
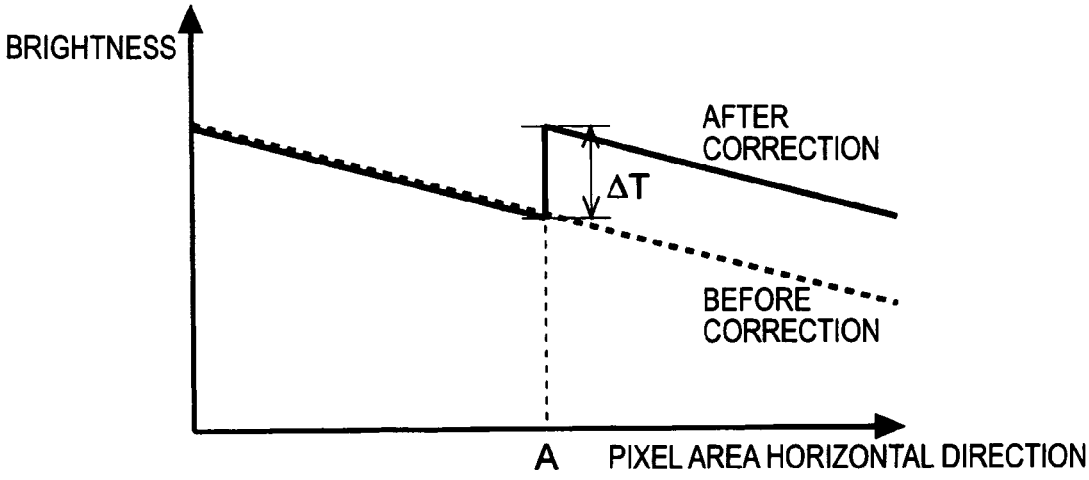

Therefore, according to the present embodiment, as shown in FIG. 4B, since the brightness difference ΔT occurring at the boundary of the display area 100*a* after the correction is decreased into ¼ compared with the case shown in FIG. 12B, it is possible to make the brightness difference invisible without increasing the number of bits constituting the correction data and without increasing the resolution of the D/A converter 304.

The unevenness of brightness caused from the cell gap, etc. is not varied in the display area 100*a*, that is, the occurrence points are fixed regardless of the images. Even when the correction data is changed at every vertical scan period, the correction at every vertical scan period is not visible with naked eyes but the integration result of the correction due to the correction data is visible.

That is, during the fourth vertical scan period, the greater correction is performed to the pixel having a greater amount of correction and the integrated value of the correction is visible. Therefore, by changing the correction data, it is possible to perform the correction with high accuracy.

In this driving method, since the time for sampling the image signals through the respective sampling switches 151 is six times as long as that of the method in which the data lines 114 are driven one by one, the charging and discharging time for the respective pixels can be sufficiently secured. Therefore, it is possible to accomplish enhancement of contrast. Since the number of stages of the shift register in the data-line driving circuit 140 and the frequency of the clock signal CLX are reduced into ⅙, respectively, it is possible to accomplish decrease of the number of stages and decrease of power consumption.

Since the active period of the sampling signals S1, S2, . . . , Sn is narrowed more than a half cycle of the clock signal CLX and is limited to the period SMPa, the overlap between the adjacent sampling signals can be prevented in advance. As a result, the image signals VID1 to VID6 which should be sampled into the six data lines 114 can be prevented from being sampled into the six data lines 114 belonging to the adjacent block, so that a high-quality display is possible.

In the aforementioned embodiment, the reference cycle comprises four vertical scan periods of the first to fourth vertical scan periods, but the present invention is not limited to this. For example, by setting the reference cycle to eight vertical scan periods of first to eighth vertical scan periods, still finer correction is possible.

Figure 11A:
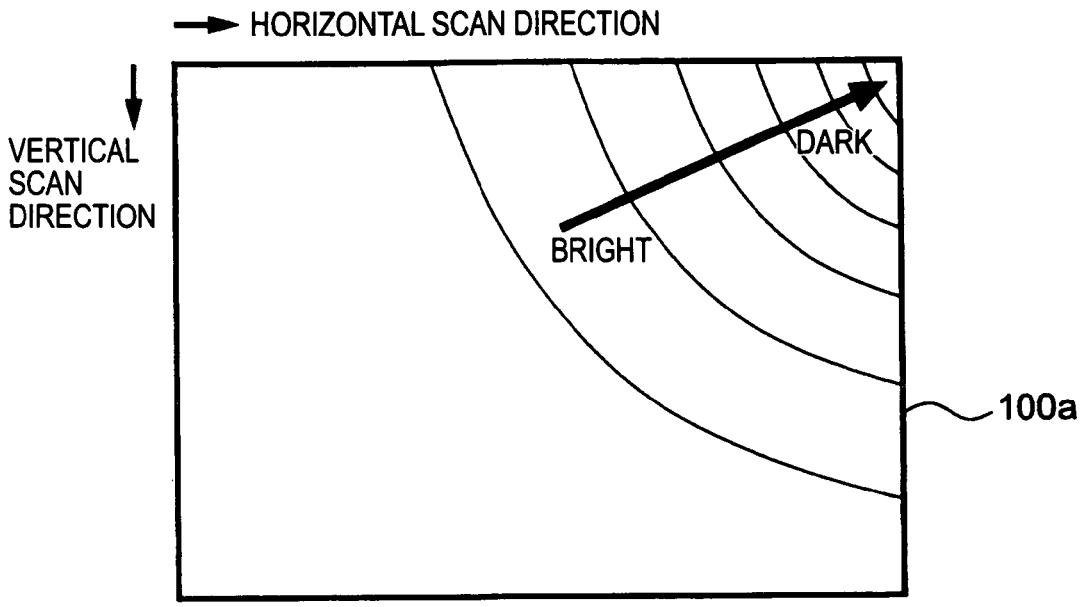
FIG. 11 is a diagram illustrating unevenness of brightness in a display panel.
Figure 11B:
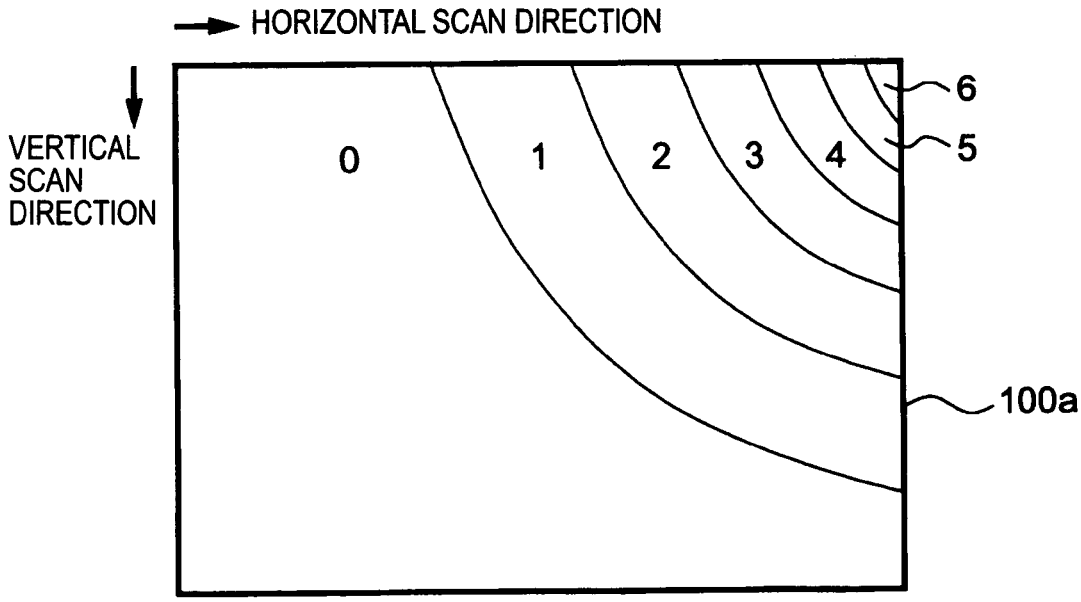

In the aforementioned embodiment, since it is supposed that the unevenness of brightness is small, the correction data converted by the conversion circuit 316 are "0" or "1". However, for example, as shown in FIG. 11A, when the unevenness of brightness is large, the correction data may include "0", "1", "2", "3", "4", "5", and "6", and the correction amount may have a decimal portion so as to include intermediate values thereof.

In the aforementioned embodiment, when the correction amount is "2/4, the correction data are "0" during the first and third vertical scan periods, and the correction data are "1" during the second and fourth vertical scan periods. In this case, since the correction data of "0" and "1" are alternately generated at every vertical scan period, the brightness difference during one vertical scan period is not easily visible as flickering. However, since the inversion of polarity for one pixel is changed at every vertical scan period, the correction data are fixed for the writing polarity. For example, the correction data are fixed as "0" at the positive writing, while the correction data are fixed as "1" at the negative writing. Therefore, an undesirable matter such as residual DC components, etc. may happen.

Therefore, as indicated by bracket marks in the column of "2/4" of FIG. 3, the correction amount may be converted into the same correction data during two vertical scan periods. By performing the conversion in this way, the ratios at which the correction data "0" and "1" are supplied are equal.

When the correction amount is "¼", the conversion of the correction data into "1" is limited to the fourth vertical scan period in FIG. 3, but the correction data may be alternately changed during the fourth vertical scan period to the first (or third) vertical scan period at every relatively long period (for example, about 100 times the first vertical scan period). Similarly, when the correction amount is "¾", the conversion of the correction data into "0" is limited to the first vertical scan period in FIG. 3, but the correction data may be alternately changed during the first vertical scan period to the second (or fourth) vertical scan period at every relatively long period.

In the present embodiment, the data indicating the brightness correction amount of the respective pixels are stored in the memory 314. In this construction, increase in the number of pixels causes enhancement of storage capacity of the memory 314. Therefore, a plurality of reference coordinates may be determined in advance in the display area 100*a*, the data indicating the correction amount corresponding to the reference coordinates may be stored, and the correction amount of an arbitrary pixel (noticed pixel) may be obtained through interpolation using the correction amount of the respective reference coordinates. That is, the correction amount of the noticed pixel may be obtained through interpolation along a gray-scale direction using the correction amount of the reference coordinates in accordance with a distance between the noticed pixel and the respective reference coordinates.

Figure 7:
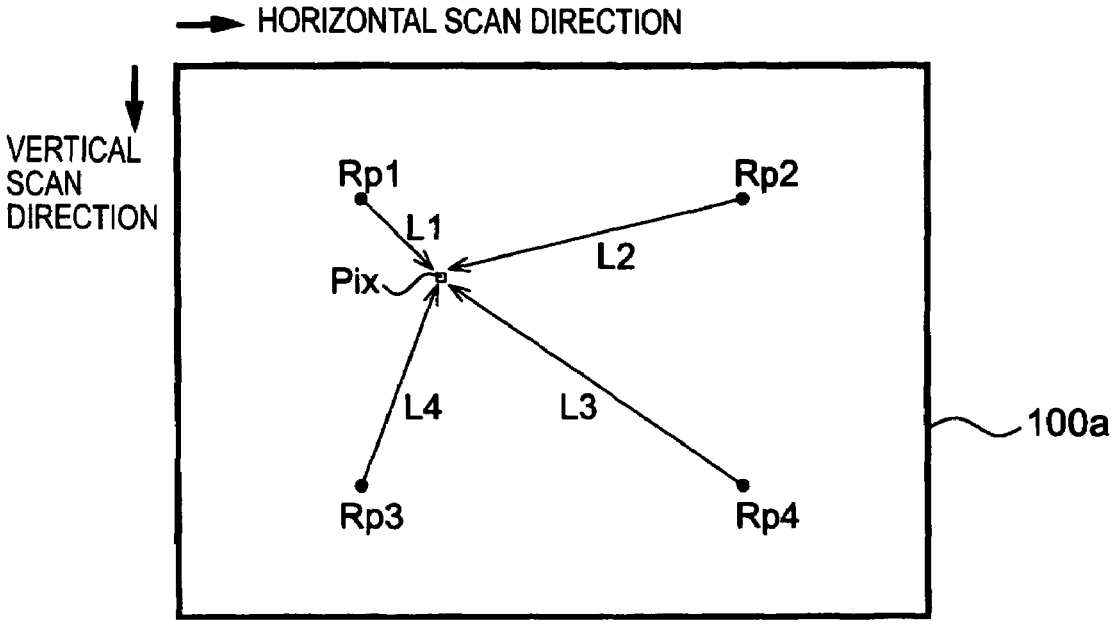
FIG. 7 is a diagram illustrating a relation between correction data resulting from another structure of the correction circuit and the pixel area.

For example, as shown in FIG. 7, the reference coordinates Rp1 to Rp4 may be determined in the display area 100*a*, the data indicating the correction amount at the respective coordinates may be stored, and then the correction amount of the pixel Pix positioned at an arbitrary coordinate may be obtained by adding the weighted values in which the correction amounts of the reference coordinates Rp1 to Rp4 are weighted in accordance with distances L1 to L4 between the pixel Pix and the reference coordinates. According to this construction, since the correction amount of the respective pixels is obtained through calculation, the calculation load is increased. However, since only the data indicating the correction amount of the reference coordinates are stored instead of the correction data corresponding to all the pixels, a memory with a large capacity is not required.

The display area 100*a* may be divided into a plurality of sub-areas, the data indicating the correction amounts for the divided sub-areas may be stored in the memory, and then the correction data may be converted in accordance with the correction amounts.

In the aforementioned embodiment, the vertical scan direction is a direction of G1→Gm and the horizontal scan direction is a direction of S1→Sn. However, in a case of a projector to be described later or a rotatable display panel, it is necessary to invert the scan direction. However, since the image data VID are supplied in synchronism with the vertical scan signal and the horizontal scan signal, it is not necessary to change the entire structure of the image-signal processing circuit 300 including the correction circuit 302.

In the aforementioned embodiment, relatively large parasitic capacitance may be generated in the data lines 114. When the parasitic capacitance is great, the sampling of the image signals from the image-signal lines 171 to the data lines 114 may not be completed in a short time. Therefore, during an arbitrary horizontal scan period, all the data lines 114 may be pre-charged to a constant voltage before sampling the image signals into the data lines 114.

In the aforementioned embodiment, the image signals VID1 to VID6 converted into six systems are sampled into the six data lines 114 constituting one block, but the number of conversion systems and the number of data lines to which simultaneous application is performed (that is, the number of data lines constituting one block) are not limited to "6". For example, when the response speed of the sampling switches 151 in the sampling circuit 150 is sufficiently fast, the corrected image signals may be sequentially sampled into the respective data lines 114 by serially supplying the corrected image signals to one image-signal line without conversion in parallel. By setting the number of conversion systems and the number of data lines subjected to simultaneous application to "3" or "12" or "24, the corrected image signals having been subjected to 3-system conversion or 12-system conversion or 24-system conversion may be simultaneously supplied to the 3 or 12 or 24 data lines. It is preferable for simplification of control or circuitry that the number of conversion systems is a multiple of 3, considering that color image signals are related to three primary colors. However, when the electro-optical device is used for a simple optical modulation as performed in a projector to be described later, the multiple of 3 is not required.

During the horizontal scan period, instead of a dot-sequential method of sequentially outputting the sampling signals S1, S2, . . . , Sn, a line-sequential method of applying the image signals to the data lines 114 at a time without passing through the image-signal lines 171 may be employed.

On the other hand, in the aforementioned embodiment, the image-signal processing circuit 300 processes the digital image data VID, but may process analog image signals. In the aforementioned embodiment, the image-signal processing circuit 300 performs the correction before performing the serial-parallel conversion of the image signals, but may perform the correction after performing the serial-parallel conversion and may not perform the serial-parallel conversion as described above.

Although the normally-white mode of performing the white display when the effective voltage value between the counter electrode 108 and the pixel electrodes 118 is small has been described in the aforementioned embodiment, the normally-black mode of performing the black display may be employed.

Moreover, in the aforementioned embodiment, a TN (Twisted Nematic) type liquid crystal is used as the liquid crystal, but a bi-stable type liquid crystal having a memory property such as a BTN (Bi-stable Twisted Nematic) ferroelectric type, a polymer distributed type liquid crystal, and a GH (Guest-Host) type liquid crystal in which dye molecules are aligned in parallel to the liquid crystal molecules by melting dye (guest), which anisotropically absorbs a visible ray in the major axis direction and the minor axis direction of the liquid crystal molecules, in a liquid crystal (host) having a constant molecule alignment may be employed.

A vertical alignment (homeotropic alignment) in which the liquid crystal molecules are aligned in a direction perpendicular to both substrates at the time of non-application of voltage and the liquid crystal molecules are aligned in a direction parallel to both substrates at the time of application of voltage may be employed. Further, a parallel (horizontal) alignment (homogeneous alignment) in which the liquid crystal molecules are aligned in a direction parallel to both substrates at the time of non-application of voltage and the liquid crystal molecules are aligned in a direction perpendicular to both substrates may be also employed. In this way, the present invention may employ various kinds of liquid crystal or alignment schemes.

The present invention may be applied to a case where the unevenness of brightness is generated due to reasons other than the cell gap. The present invention may be applied to, for example, a case where the unevenness of brightness is generated due to variation in characteristics of transistors (which correspond to TFT 116 in the aforementioned embodiment) for driving the pixels or line resistance of the scanning lines 112 and the data lines 114. Therefore, the display panel is not limited to the liquid crystal panel, but the present invention may be applied to other panels such as an organic/inorganic EL device, a field emission device, a light-emitting device such as an LED, an electrophoresis device, and other panels using a electro-chromic device.

<Electronic Apparatus>

Next, several electronic apparatuses having the electro-optical device according to the aforementioned embodiment will be described.

(Projector)

Figure 8:
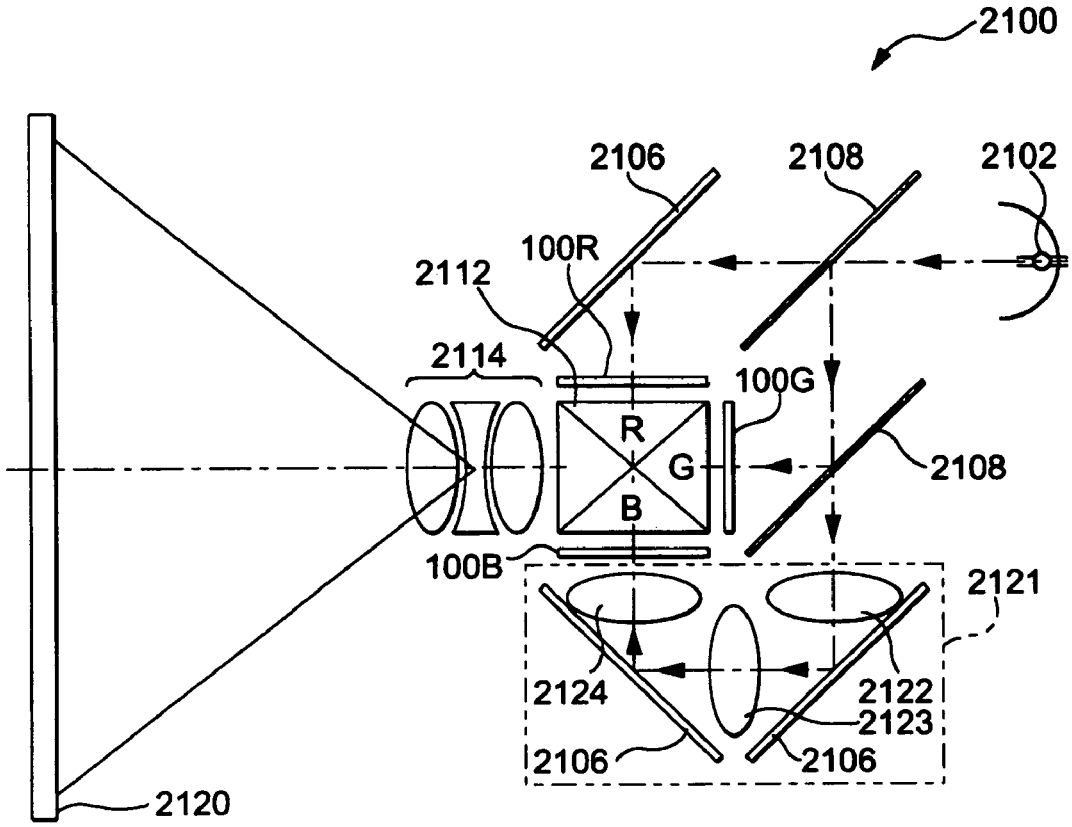
FIG. 8 is a cross-sectional view illustrating a structure of a projector as an example of an electronic apparatus to which the electro-optical device according to the embodiment is applied.

First, a projector having the aforementioned liquid crystal panel 100 as light valves will be described. FIG. 8 is a cross-sectional view illustrating a structure of the projector. As shown in the figure, a lamp unit 2102 comprising a white light source such as a halogen lamp, etc. is provided inside the projector 2100. The projection light emitted from the lamp unit 2102 is separated into three primary colors of R (red color), G (green color), and B (blue color) by three mirrors 2106 and two dichroic mirrors 2108 disposed therein, and is then guided to light valves 100R, 100G, and 100B corresponding to the respective primary colors. Since the light component of R color has an optical path longer than those of R color or G color, the light component of B color is guided through a relay lens system 2121 including an incident lens 2122, a relay lens 2123, and an emission lens 2124 so as to prevent loss thereof.

Here, the light valves 100R, 100G, and 100B have the same structure as that of the liquid crystal panel 100 according to the aforementioned embodiment, and are driven with the image signals corresponding to the respective colors R, G, and B supplied from the image-signal processing circuit (omitted in FIG. 8). That is, in the projector 2100, three electro-optical devices including the liquid crystal panel 100 are provided correspondingly to the respective colors R, G, and B, so that the unevenness of brightness of the respective display panels corresponding to the colors is corrected.

The light components modulated by the light valves 100R, 100G, and 100B, respectively, are incident on the dichroic prism 2112 from three directions. In the dichroic prism 2112, the light components of R color and B color are refracted by 90°, while the light component of G color goes straightly. Therefore, the images of the respective colors are synchronized, and then a color image is projected onto a screen 2120 through a projection lens 2114.

When the cell gaps of the light valves 100R, 100G, and 100B are not uniform, the unevenness of brightness appears in every color, but when three colors are synchronized, unevenness of color appears. In the present embodiment, since the unevenness of brightness for each color is corrected with high accuracy, the unevenness of color when three colors are synchronized is also corrected with high accuracy.

Since the light components corresponding to the respective primary colors R, G, and B are applied to the light valves 100R, 100G, and 100B through the dichroic mirror 2108, it is not necessary to provide the color filters described above. The images passing through the light valves 100R and 100B are reflected from the dichroic mirror 2112 and then projected, while the image passing through the light valve 100G is projected as it is. Therefore, the horizontal scan direction by the light valves 100R and 100B is opposite to the horizontal scan direction by the light valve 100G, so that the images of which the right and left sides are reversed are displayed.

(Mobile Computer)

Figure 9:
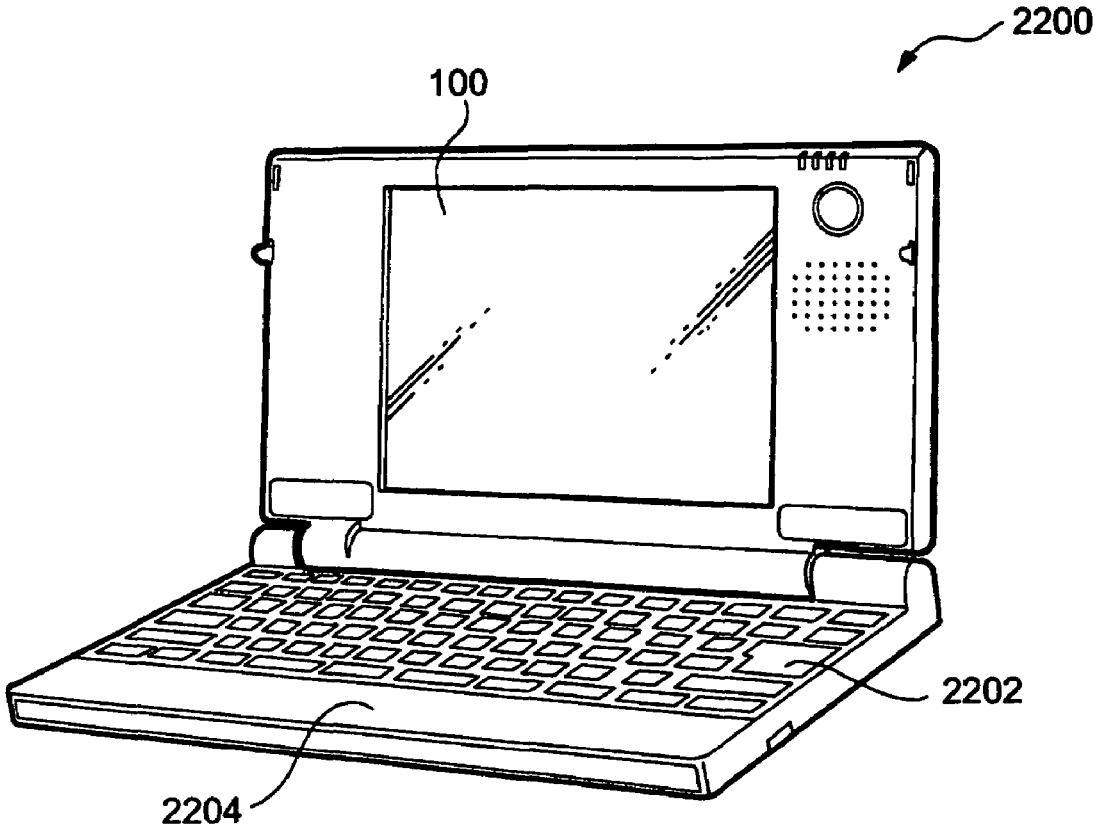
FIG. 9 is a perspective view illustrating a structure of a personal computer as another example of an electronic apparatus to which the electro-optical device according to the embodiment is applied.

Next, an example where the aforementioned electro-optical device is applied to a mobile personal computer will be described. FIG. 9 is a perspective view illustrating a structure of the personal computer. In the figure, the computer 2200 comprises a main body 2204 having a keyboard 2202 and a liquid crystal panel 100 used as a display unit. The rear surface thereof is provided with a backlight unit (not shown) for enhancing visibility.

(Mobile Phone)

Figure 10:
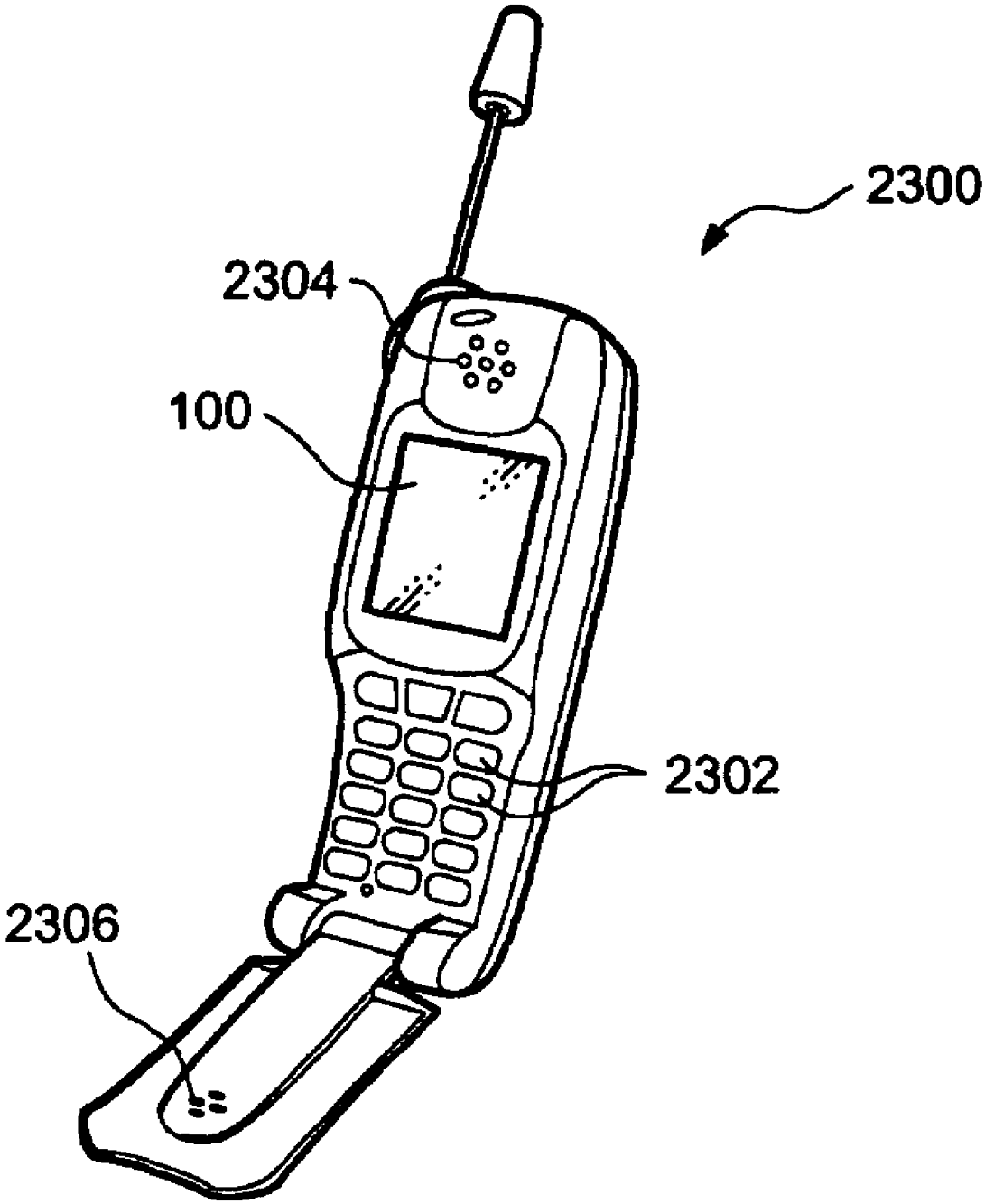
FIG. 10 is a perspective view illustrating a structure of a mobile phone as another example of an electronic apparatus to which the electro-optical device according to the embodiment is applied.

Next, an example where the aforementioned electro-optical device is applied to a display unit of a mobile phone will be described. FIG. 10 is a perspective view illustrating a structure of the mobile phone. In the figure, the mobile phone 2300 comprises a plurality of manipulation buttons 2302, a receiver 2304, a transmitter 2306, and a liquid crystal panel 100 used as a display unit. The rear surface of the liquid crystal panel 100 is also provided with a backlight unit (not shown) for enhancing visibility.

(Other Electronic Apparatuses)

Examples of the electronic apparatus may include a television, a view finder type or monitor direct vision-type video tape recorder, a car navigation apparatus, a pager, an electronic pocket book, a calculator, a word processor, a work station, a television phone, a POS terminal, a digital still camera, an apparatus having a touch panel, and the like. It is not to say that the display panel according to the present invention can be applied to the various electronic apparatuses, in addition to the electronic apparatuses described with reference to FIGS. 8, 9, and 10.

What is claimed is:

1. A method of correcting unevenness of brightness of pixels by adding correction data corresponding to a pixel to image data specifying the brightness of the pixel, wherein a reference cycle includes a plurality of vertical scan periods and during the respective vertical scan periods of the reference cycle, one of two different data values is selected and the selected data value is output as correction data, wherein one of two different data values is supplied during at least two consecutive vertical scan periods and the other of the two different data values is supplied during at least two other consecutive vertical scan periods, a polarity of the image data centering about a predetermined potential is different in each of the at least two consecutive vertical scan periods;

wherein the number of times when one of the two data values is supplied during the reference cycle is increased as a correction amount comes close to the one data value, wherein a plurality of reference coordinates is determined in advance in a pixel area and data indicating the correction amount are stored for each reference coordinate, and wherein data indicating a correction amount of a pixel are obtained by interpolating the correction amount of the respective reference coordinates in accordance with distances between the reference coordinates and the pixel.

2. The method of correcting unevenness of brightness according to claim 1, wherein a time when the two data values are alternately supplied is provided in every vertical scan period.

3. The method of correcting unevenness of brightness according to claim 1, wherein the same data value is supplied during two vertical scan periods and a time when the two data values are alternately supplied is provided in every two vertical scan periods.

4. The method of correcting unevenness of brightness according to claim 1, wherein data indicating the correction amount are stored in advance correspondingly to the respective pixels.

5. A correction circuit that corrects unevenness of brightness of pixels by adding correction data corresponding to a pixel to image data specifying the brightness of the pixel, wherein a reference cycle includes a plurality of vertical scan periods and during the respective vertical scan periods of the reference cycle, one of two different data values is selected and the selected data value is output as correction data, wherein one of two different data values is supplied during at least two consecutive vertical scan periods and the other of the two different data values is supplied during at least two other consecutive vertical scan periods, a polarity of the image data centering about a predetermined potential is different in each of the at least two consecutive vertical scan periods;

wherein the number of times when one of the two data values is supplied during the reference cycle is increased as a correction amount comes close to the one data value, wherein a plurality of reference coordinates is determined in advance in a pixel area and data indicating the correction amount are stored for each reference coordinate, and wherein data indicating a correction amount of a pixel are obtained by interpolating the correction amount of the respective reference coordinates in accordance with distances between the reference coordinates and the pixel.

6. The correction circuit that corrects unevenness of brightness according to claim 5, wherein data indicating the correction amount are stored in advance correspondingly to the respective pixels.

7. The correction circuit that corrects unevenness of brightness according to claim 5, wherein it is determined which vertical scan period of the reference cycle a current vertical scan period is, and one of the two data values is selected on the basis of the determination result.

8. An electro-optical device comprising:

the correction circuit that corrects unevenness of brightness according to claim 5; and a display panel in which image signals obtained by converting image data from the correction circuit into analog signals are written to corresponding pixels.

9. An electronic apparatus comprising the electro-optical device according to claim 8 as a display unit.

10. A projector comprising a light source, the electro-optical device according to claim 8, and a lens system.

11. An electro-optical device in which a plurality of pixels is disposed in a display area and image signals obtained by converting image data into analog signals are supplied to the pixels, the electro-optical device comprising:

a memory that stores in advance a separate predetermined brightness correction amount for each of the plurality of pixels; and a correction circuit that, during a predetermined cycle, judges a largeness of the brightness correction amount and increases the number of times when the image data are corrected using predetermined correction data according to the largeness of the brightness correction, wherein the correction circuit corrects using one of two different data values being supplied during at least two consecutive vertical scan periods and using the other of the two different data values being supplied during at least two other consecutive vertical scan periods, a polarity of the image data centering about a predetermined potential is different in each of the at least two consecutive vertical scan periods.

12. An electro-optical device in which a plurality of pixels is disposed in a display area and image signals obtained by converting image data into analog signals are supplied to the pixels, the electro-optical device comprising:

a memory that stores in advance predetermined brightness correction amounts for the plurality of pixels; and a correction circuit that employs a plurality of vertical scan periods as a reference cycle, corrects the image data using predetermined correction data every predetermined number of vertical scan periods of the reference cycle, and increases the number of vertical scan periods during which the image data are corrected as the pixels have a larger brightness correction amount, wherein the correction circuit corrects using one of two different data values being supplied during at least two consecutive vertical scan periods and using the other of the two different data values being supplied during at least two other consecutive vertical scan periods, a polarity of the image data centering about a predetermined potential is different in each of the at least two consecutive vertical scan periods.

13. The electro-optical device according to claim 12, wherein the brightness correction amounts are determined depending upon positions of the pixels.

14. The electro-optical device according to claim 12, wherein the correction circuit has a reading-out circuit for specifying positions of the pixels to which the image signals corresponding to the image data are supplied.

15. The electro-optical device according to claim 12, wherein the brightness correction amount corresponding to a pixel is output from the memory on the basis of the position of the pixel specified by the reading-out circuit.

16. The electro-optical device according to claim 15, wherein the display area is divided into a plurality of sub-areas and the memory stores the brightness correction amounts corresponding to the respective sub-areas.

17. The electro-optical device according to claim 12, wherein the image signals are inverted to a higher potential and a lower potential than a predetermined potential.

18. The electro-optical device according to claim 17, wherein the correction circuit performs the correction during both vertical scan periods when the image signals have a higher potential than the predetermined potential and when the image signals have a lower potential than the predetermined potential.

* * * * *